US009914514B2

(12) United States Patent
Coblitz et al.

(10) Patent No.: US 9,914,514 B2
(45) Date of Patent: Mar. 13, 2018

(54) SUBSEA VESSEL AND USE

(71) Applicant: CONOCOPHILLIPS COMPANY, Houston, TX (US)

(72) Inventors: Scott E. Coblitz, Houston, TX (US); Amal C. Phadke, Houston, TX (US); Derrick Laskowski, Houston, TX (US); Dan Mueller, Houston, TX (US); Daniel R. Givan, Houston, TX (US); George Z. Gu, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 14/800,861

(22) Filed: Jul. 16, 2015

(65) Prior Publication Data

US 2016/0023732 A1 Jan. 28, 2016

Related U.S. Application Data

(60) Provisional application No. 62/027,611, filed on Jul. 22, 2014.

(51) Int. Cl.

| | |
|---|---|
| ***B63G 8/00*** | (2006.01) |
| ***B63G 8/04*** | (2006.01) |
| ***E02B 17/02*** | (2006.01) |
| ***E21B 43/01*** | (2006.01) |
| ***B63B 35/00*** | (2006.01) |
| ***B63G 8/22*** | (2006.01) |
| *E02B 17/00* | (2006.01) |

(52) U.S. Cl.

CPC ..... *B63G 8/001* (2013.01); *B63B 35/003* (2013.01); *B63G 8/04* (2013.01); *B63G 8/22* (2013.01); *E02B 17/02* (2013.01); *E02B 17/021* (2013.01); *E21B 43/01* (2013.01); *B63G 2008/002* (2013.01); *E02B 2017/0043* (2013.01); *E02B 2017/0047* (2013.01); *E02B 2017/0052* (2013.01)

(58) Field of Classification Search

CPC .. B63G 8/001; B63G 8/04; B63G 8/22; B63B 35/003; E02B 17/02; E02B 17/021; E21B 43/01

USPC ..... 405/195.1, 200, 203–208

See application file for complete search history.

(56) References Cited

U.S. PATENT DOCUMENTS

| | | | | | |
|---|---|---|---|---|---|
| 3,828,565 | A * | 8/1974 | McCabe | F17C 3/02 | 114/256 |
| 4,002,482 | A * | 1/1977 | Coenen | C03C 3/078 | 106/628 |
| 4,188,157 | A * | 2/1980 | Vigander | E02B 17/025 | 405/207 |
| 4,303,732 | A * | 12/1981 | Torobin | B29C 49/46 | 126/709 |
| 4,318,361 | A | 3/1982 | Sluys | | |
| 4,664,556 | A * | 5/1987 | Dixon | E02D 15/06 | 405/195.1 |

(Continued)

*Primary Examiner* — Tara Mayo-Pinnock
(74) *Attorney, Agent, or Firm* — ConocoPhillips Company

(57) ABSTRACT

A subsea vessel includes filler material, which may be enclosed by an outer shell and may provide the vessel with a density for floatation. Exemplary applications for the vessels include buoyancy and tanks to hold fluids for operations subsea. The filler may include thermoplastic materials and/or concrete, which may be formed to create internal void spaces.

13 Claims, 4 Drawing Sheets

(56) References Cited

U.S. PATENT DOCUMENTS

| | | | | |
|---|---|---|---|---|
| 5,224,962 | A * | 7/1993 | Karal | B63B 22/023 405/203 |
| 6,286,707 | B1 | 9/2001 | Hall et al. | |
| 2015/0132066 | A1 | 5/2015 | Phadke et al. | |
| 2015/0225043 | A1 | 8/2015 | Gu et al. | |

* cited by examiner

SUBSEA VESSEL AND USE

CROSS-REFERENCE TO RELATED APPLICATIONS

This application is a non-provisional application which claims benefit under 35 USC § 119(e) to U.S. Provisional Application Ser. No. 62/027,611 filed Jul. 22, 2014, entitled "SUBSEA VESSEL AND USE" which is incorporated herein in their entirety.

FIELD OF THE INVENTION

Embodiments of the invention relate to subsea vessels, which may be utilized for buoyancy or to otherwise hold fluids for operations subsea.

BACKGROUND OF THE INVENTION

Offshore oil and natural gas exploration and production utilize above-sea platforms to support drilling and/or processing equipment for extracting resources from subsea wells. The above-sea platforms mount to a system of fluid transfer and mooring lines extending from the platforms to the sea floor. The platforms may include drilling systems, transport systems, support equipment, such as electrical power generation, and crew accommodations. In addition to above-sea platforms, many offshore operations include subsea platforms to support various systems at or near the sea floor.

Subsea platforms may include sub-systems, which are transported to a particular site, submerged, integrated to form one or more subsea systems, and tested. Current technology limits transport and positioning of each sub-system to be less than 500 metric tons (MT). Therefore, installation of the subsea platform may be a lengthy process depending upon size, weight, and number of sub-systems. More specifically, a subsea system may require multiple support ships to transport and position each sub-system as well as a lengthy construction and testing phase prior to being ready for operation.

One issue with deploying the subsea platform relates to a lack of desirable options for providing buoyancy. High pressure in deepwater environments, with depths exceeding 3000 meters, and economical constraints contribute to problems associated with designing the buoyancy. High pressure and economic constraints also impact other subsea tank based applications, which may employ corresponding designs as used for the buoyancy tank.

Therefore, a need exists for subsea vessels to provide cost effective options for deepwater applications, including buoyancy during deployment of subsea platforms.

SUMMARY OF THE INVENTION

In one embodiment, a method of using a subsea vessel for buoyancy includes floating the vessel in water. The vessel includes a shell arranged around at least one inner enclosure containing gas with concrete material poured to fill between the shell and the enclosure. The method further includes submerging the vessel until supported by a seabed.

For one embodiment, a subsea vessel includes a concrete material forming the vessel. The concrete material includes glass bubbles or other low-density material. A design alternative is to use a higher concentration of the bubbles or low-density material toward a top of the vessel than at the bottom of the vessel to create a density profile for the concrete material increasing toward the bottom of the vessel.

BRIEF DESCRIPTION OF THE DRAWINGS

The invention, together with further advantages thereof, may best be understood by reference to the following description taken in conjunction with the accompanying figures by way of example and not by way of limitation.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope of the invention. For instance, features illustrated or described as part of one embodiment can be used on another embodiment to yield a still further embodiment. Thus, it is intended that the present invention cover such modifications and variations that come within the scope of the appended claims and their equivalents.

Embodiments of the invention relate to subsea vessels for applications such as buoyancy and tanks to hold fluids for operations subsea. For example, the vessels may store chemicals for injection into a wellbore or facilitate separation of phases in produced fluids. While shown herein with a particular system for delivering equipment subsea, any method or structures in which a subsea tank or buoyancy is desired may employ suitable versions of the subsea vessels described herein. The vessel may include a shell surrounding a filler to provide the vessel with a density for floatation. The filler may include thermoplastic materials and/or concrete, which may be formed to create internal void spaces.

Figure 1:
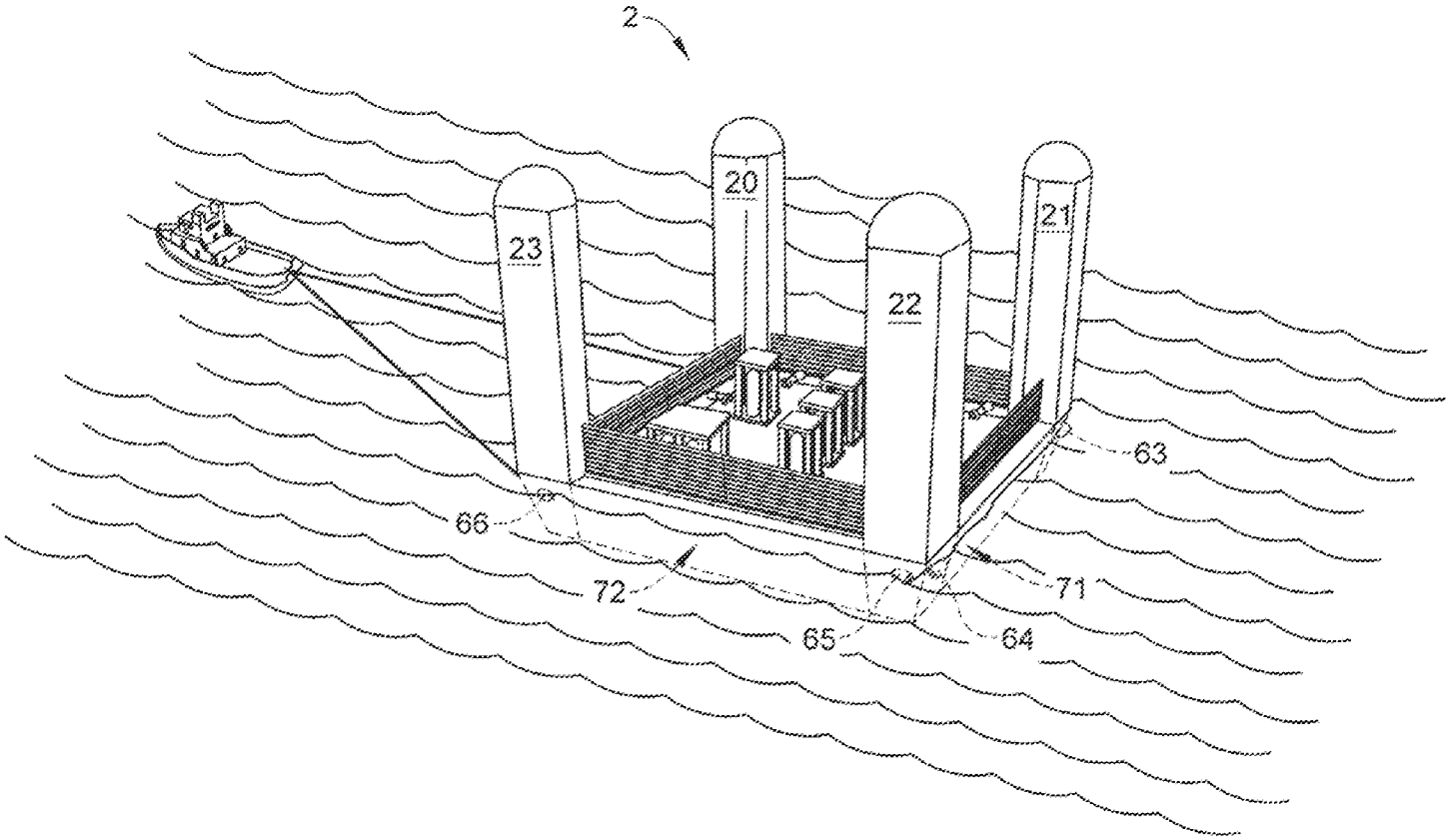
FIG. 1 depicts subsea vessels used to provide buoyancy for a subsea platform transporter shown being towed in water, according to embodiments of the invention.

FIG. 1 illustrates an exemplary subsea platform transporter (SPT) 2 being towed by a boat and including subsea vessels, such as a first column member 20, a second column member 21, a third column member 22 and a fourth column member 23 for buoyancy as described further herein. Each column member 20-23 includes one or more internal cavities filled with a buoyant material and together may provide primary buoyancy for the SPT 2. The SPT 2 may further include a plurality of thrusters 63, 64, 65, 66 to maneuver the SPT 2 into a desired position along with a first pontoon member 71, a second pontoon member 72 and additional pontoons not visible to form a rectangular shape.

Figure 2:
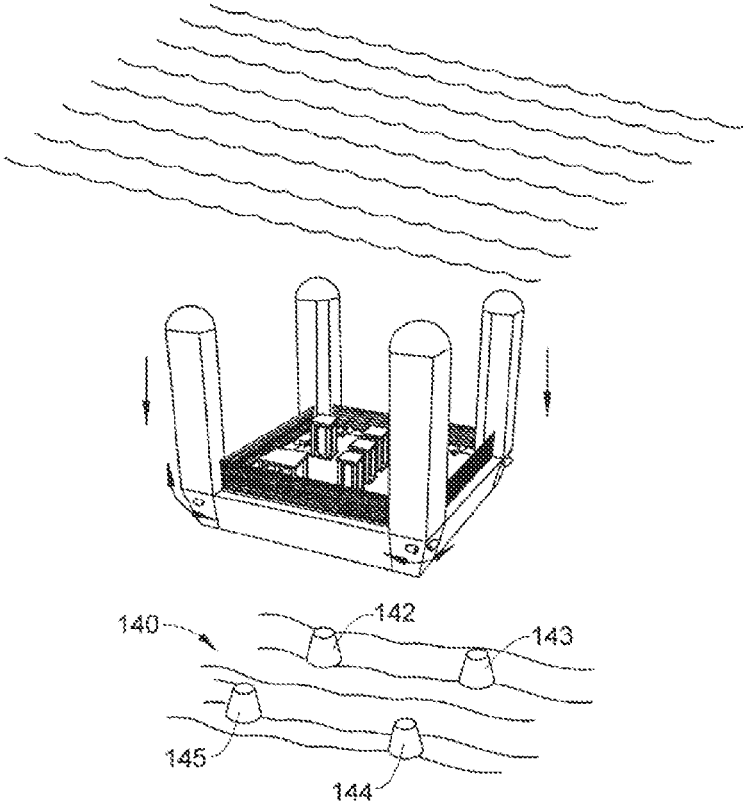
FIG. 2 depicts the subsea platform transporter submerging toward a desired location on the sea floor, according to embodiments of the invention.

FIG. 2 shows the SPT 2 submerging toward a support structure 140 having a plurality of support members 142, 143, 144, 145 on the seabed. In operation, the boat shown in FIG. 1 transports the SPT 2 to a desired position above the support structure 140. The boat then releases the SPT 2 to enable submergence with a controller providing a support vessel based operator with functionality to control buoyancy of the column members 20-23 and/or auxiliary buoyancy members, a platform release mechanism and/or the thrusters 63-66.

For example, controlling the buoyancy may involve filling the column members 20-23 and/or the auxiliary buoyancy members with sea water to facilitate gradual descent of the SPT 2. Once the SPT 2 nears the support members 142-145, the thrusters 60-67 activate to achieve a desired alignment for resting upon the support members 142-145. The platform release mechanism then disengages the SPT 2 for recovery of the SPT 2.

Figure 3:
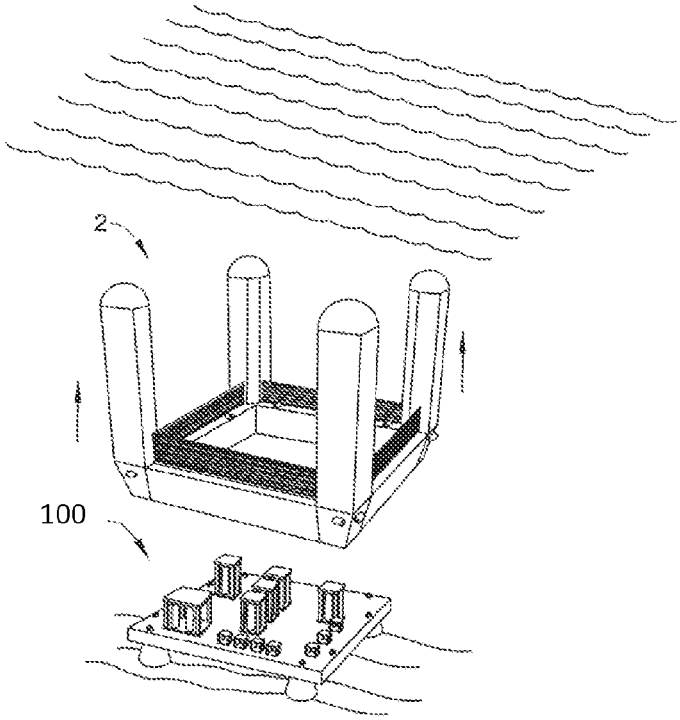
FIG. 3 depicts ascent of the subsea platform transporter following release of a subsea platform, according to embodiments of the invention.

FIG. 3 illustrates the SPT 2 after the platform release mechanism has disengaged the SPT 2 from a subsea platform 100 and the SPT 2 begins to ascend toward the sea surface due to weight of the platform 100 being decoupled from the SPT 2. Once at the sea surface, the boat tows the SPT 2 back to dock. The SPT 2 employing the column members 20-23 described below in more detail thus provides efficient delivery of the subsea platform 100.

Figure 4:
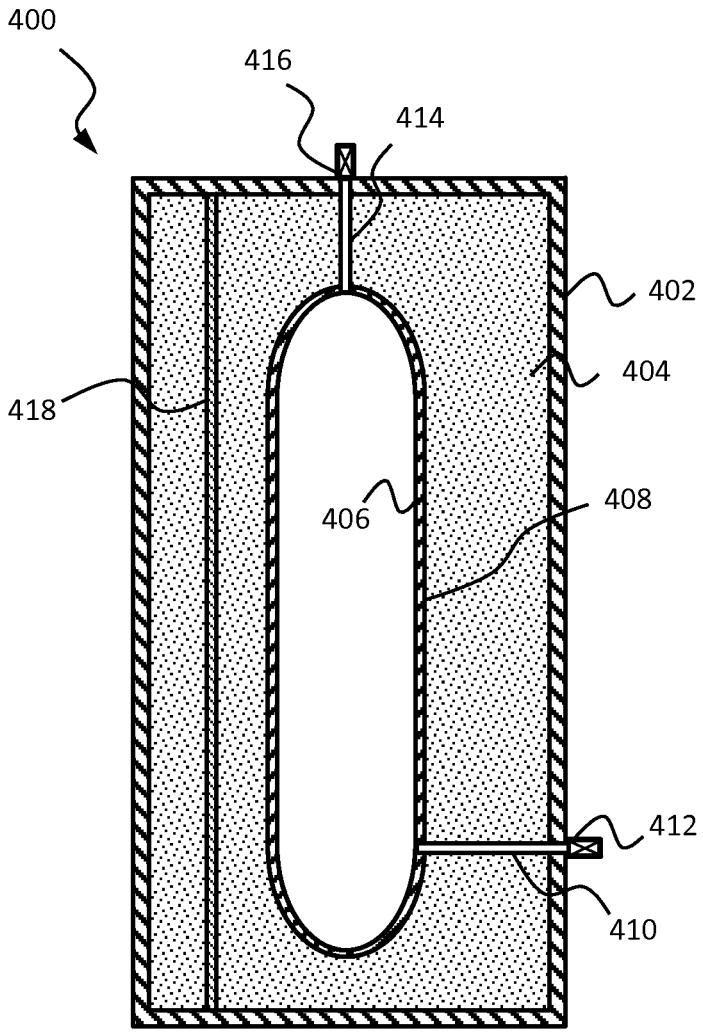
FIG. 4 depicts a cross sectional view of an exemplary subsea vessel with a void space and conduits into the void space for flooding to add weight, according to embodiments of the invention.

FIG. 4 shows an exemplary subsea vessel 400, which may be used to provide each of the column members 20-23 depicted in FIG. 1. In some embodiments, the vessel 400 includes an outer shell 402 forming a closed shape, such as a rectangular block or cylinder. A steel material may provide the shell 402 and acts as a sealant to prevent water contact with filler, such as concrete 404, and/or provides tensile strength for structural integrity to the vessel 400. While the concrete 404 may be used without the shell 402 altogether, other coating options may be painted directly onto the concrete to provide the shell 402 and avoid the use of steel.

In some embodiments, the concrete 404 pours into an annulus between the shell 402 and an inner enclosure 406, which may also be formed of steel, and fills in to surround the enclosure 406. The enclosure 406 also forms a closed shape, such as a rectangular block or cylinder, and may be horizontally/vertically concentric with the shell 402. An interior of the enclosure 406 thereby defines a void space 408 within the vessel 400. Gas, such as air, filling the void space 408 contributes to buoyancy of the vessel 400 with increase in size of the void space 408 providing more buoyancy. Fixing or otherwise maintaining the enclosure 406 relative to the shell 402 while pouring the concrete 404 ensures the enclosure is arranged and oriented as desired.

For some embodiments, the concrete 404 density ranges from 700 kilograms per cubic meter to 1000 kilograms per cubic meter, is less than water density or is less than 1025 kilograms per cubic meter. The concrete 404 may include a mixture of cement and particles less dense than the cement such as hollow gas filled glass microspheres, i.e., glass bubbles, to provide the desired density achievable given structural requirements. In some embodiments, the concrete 404 may change density from one end of the vessel 400 to the opposite end for generating an inherent submerged stabile orientation of the vessel 400. For example, the density of the concrete 404 toward a top of the vessel 400 may be less than 900 kilograms per cubic meter while the concrete 404 lower in the vessel 400 may be greater than 900 kilograms per cubic meter.

A lower percentage of glass bubbles in the concrete 404 at a base of the vessel 400 relative to percentage of glass bubbles in the concrete 404 toward a top of the vessel 400 may provide such a density profile. Some embodiments may create the density profile by placement of the void space 408 within the vessel 400. Placement of the concrete 404 with relative higher density toward the base also helps provide additional strength and structural support at locations often experiencing highest loading.

According to some embodiments, the vessel 400 further includes a water intake conduit 410 with intake valve 412 and an air outlet conduit 414 with check valve 416. The intake conduit 410 and the outlet conduit 414 provide fluid communication pathways between an exterior of the vessel 400 and the void space 408. Control of the intake valve 412 enables flooding the void space 408 with water to add weight to the vessel 400, which may be utilized to facilitate submergence, such as shown in FIG. 2.

In operation, an operator, by remote command or manually by a remotely operated vehicle, may open the inlet valve 412 to start filling of the void space 408 with the water as the check valve 416 releases air compressed by the water. The weight of the vessel 400 increases enough to cause sinking of the vessel 400 and components coupled thereto at a certain depth, even though the vessel 400 may remain buoyant at other depths and may thus facilitate the ascent shown in FIG. 3 when such components are released from the vessel 400. A hemispherical dome or sloped top to the enclosure 406 along with location of the outlet conduit 414 at the apex for venting ensures all the air escapes avoiding contained high pressures within the vessel 400. According to some embodiments, a hemispherical dome may be used at the top and the bottom of the enclosure 406 to assist with the structural design.

The concrete 404 provides compressive strength to the vessel 400. In addition, the vessel 400 may include reinforcing steel bar or rebar 418 as required by structural designs. While the rebar 418 visible is a single longitudinal piece in the annulus, the vessel 400 may have multiple parallel ones of the rebar 418 dispersed around the annulus and/or reinforcing steel rings disposed in the annulus perpendicular to the rebar 418.

Figure 5:
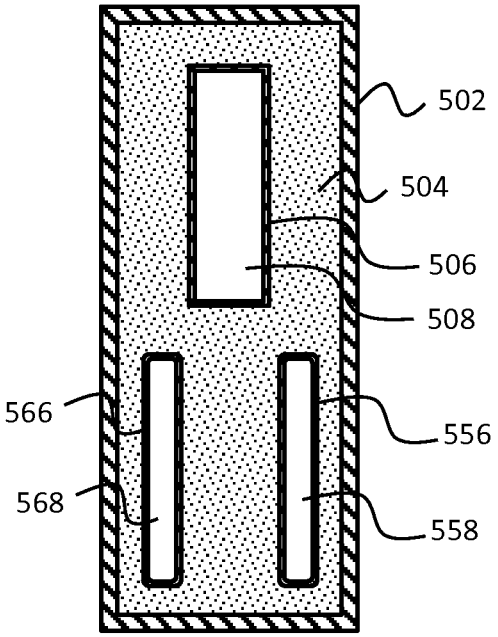
FIG. 5 depicts a cross sectional view of a compartmentalized subsea vessel having sealed void spaces, according to embodiments of the invention.

FIG. 5 illustrates a compartmentalized subsea vessel formed, similar to FIG. 4, by a shell 502 surrounding concrete 504. A first enclosure 506, a second enclosure 556 and a third enclosure 566 within the concrete 504 provide a first void space 508, a second void space 558 and a third void space 568, respectively. While not visible, additional enclosures to a front and back may form a radial pattern in combination with the second enclosure 556 and the third enclosure 566.

The first enclosure 506 occupies a center upper area within the concrete 504 and is misaligned in both horizontal and vertical directions with both the second enclosure 556 and the third enclosure 566, which are located in a relative lower area of the concrete 504. As shown by example with the first void space 508 being larger than the second and third void spaces 558, 568, size and configuration of the void spaces 508, 558, 568 may differ from one another to provide desired structural and buoyancy properties. In contrast to a dome top, the enclosures 506, 556, 566 may include a flat top plate since sealed from an external environment to provide a fixed amount of buoyancy without being utilized for changing buoyancy. Without need for external fluid communication, the concrete 504 may provide complete encapsulation of the enclosures 506, 556, 566.

In some embodiments, the enclosures 506, 556, 566 contain pressurized gas at, for example, at least 6,500 kilopascals (kPa) and within a maximum structural containment limit while on surface and exposed to atmospheric pressure or less than a maximum external pressure anticipated. This pressurization facilitates the concrete 504 resisting crush due to external pressure at water depths, such as 3000 meters, where intended for use. The pressurization of the enclosures 506, 556, 566 limits a pressure differential and resulting force since the external pressure may be at least 31,000 kPa, for example.

Figure 6:
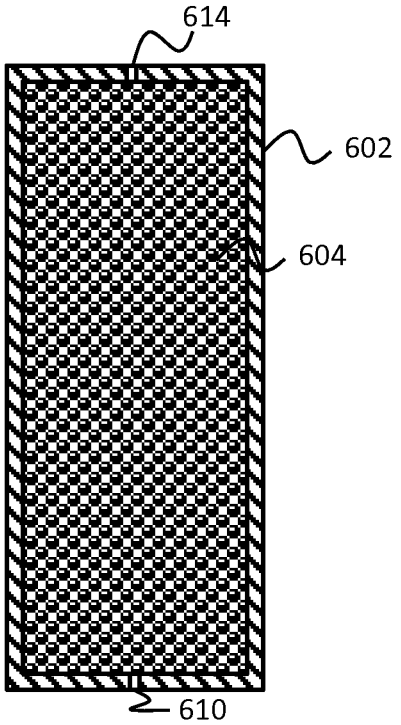
FIG. 6 depicts a cross sectional view of another subsea vessel at least partially filled with a thermoplastic or other low-density material, according to embodiments of the invention.

FIG. 6 shows another subsea vessel with a shell 602 at least partially filled with a thermoplastic 604 having a density less than 900 kilograms per cubic meter. Exemplary shapes for the thermoplastic 604 include spheres, cylindrical pellets, discs or blocks. For ease of installation and given commercial availability without requiring molding, some embodiments utilize the spherical or cylindrical pellets, which also enable efficient packing of the thermoplastic 604 within the shell 602.

In some embodiments, openings, such as lower aperture 610 and upper aperture 614 through the shell 602, permit fluid communication between inside and outside the shell 602. Water passes through the apertures 610, 614 and fills an interstitial space between the objects of the thermoplastic 604. Thus, submerging avoids issues of crushing the shell 602 since there is no pressure containment by the shell 602.

Figure 7:
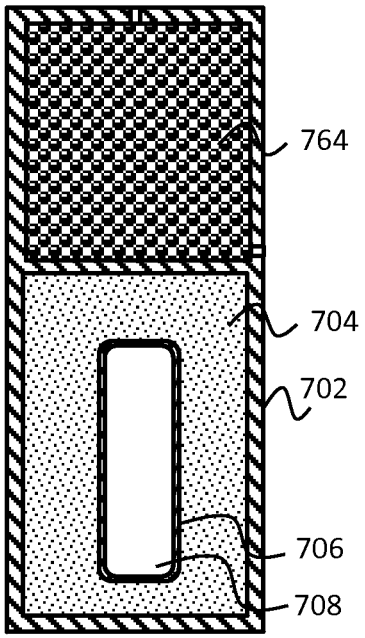
FIG. 7 depicts a cross sectional view of a mixed media subsea vessel illustrating an exemplary combination of features and including a concrete filler, thermoplastic and a void space, according to embodiments of the invention.

FIG. 7 illustrates a mixed media subsea vessel with a shell 702 and showing an exemplary combination of features including concrete 704, an enclosure 706 creating a void space 708, and thermoplastic filler 764, such as described with respect to FIG. 6. The shell 702 separates the concrete 704 with the enclosure 706 from the thermoplastic filler 764. In some embodiments, the thermoplastic filler 764 may be lighter than the concrete 704, which may be heavier than water, to create a desired density and/or density profile.

Figure 8:
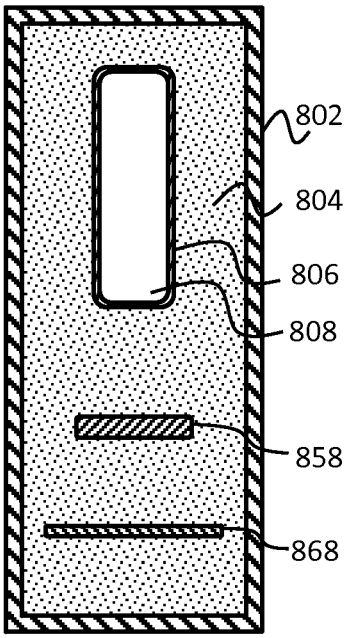
FIG. 8 depicts a cross sectional view of another mixed media subsea vessel illustrating an exemplary combination of features and including a concrete filler, thermoplastic discs and a void space, according to embodiments of the invention.

FIG. 8 illustrates another mixed media subsea vessel with a shell 802 and showing an exemplary combination of features including concrete 804, an enclosure 806 creating a void space 808, a thermoplastic first disc 858 and a thermoplastic second disc 868. While a couple mixed media are depicted and not all combinations of the features described with respect to the FIGS. 4-8 are shown for conciseness, various other attributes described may be combined as desired. The enclosure 806 and discs 858, 868 embedded in the concrete 804 within the shell 802 have a stacked orientation with the enclosure 806 disposed above the first disc 858, which is disposed above the second disc 868. As again shown by example with the first disc 858 being thicker and of smaller diameter than the second disc 868, size and configuration of the discs 858, 868 may differ from one another to provide desired structural and buoyancy properties.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of using a subsea vessel for buoyancy, comprising:

floating the vessel in water coupled by releasable engagement with a platform having equipment for delivery subsea, wherein the vessel includes a shell arranged around at least one inner enclosure containing gas with concrete material poured to fill between the shell and the enclosure;

submerging the vessel until supported by a seabed; and releasing the engagement of the platform from the vessel thereby leaving the equipment subsea and causing ascent of the vessel from the seabed for recovery of the vessel.

2. The method according to claim 1, wherein the gas in the enclosure is pressurized to at least 6500 kilopascals.

3. The method according to claim 1, wherein the submerging includes increasing the weight of the vessel by introducing the water into the inner enclosure through a valve.

4. The method according to claim 1, wherein steel forms the shell and the inner enclosure.

5. The method according to claim 1, wherein the shell and the inner enclosure are concentric cylinders.

6. The method according to claim 1, wherein the inner enclosure has a domed top with a conduit at an apex of the top providing fluid communication through a check valve to an exterior of the vessel for venting the gas as the enclosure is flooded for the submerging.

7. The method according to claim 1, wherein the at least one inner enclosure includes a plurality of enclosures arranged in the shell.

8. The method according to claim 1, wherein the vessel further includes thermoplastic pellets contributing to the buoyancy.

9. The method according to claim 1, wherein the concrete material has a density less than the water.

10. The method according to claim 1, wherein density of the vessel increases toward a bottom of the vessel.

11. The method according to claim 1, wherein the concrete material has a density profile that increases toward a bottom of the vessel.

12. The method according to claim 1, wherein the concrete material includes glass bubbles.

13. The method according to claim 1, wherein the concrete material includes glass bubbles with a higher concentration of the bubbles toward a top of the vessel than a bottom of the vessel to create a density profile increasing toward the bottom of the vessel.

* * * * *